US006757997B1

(12) United States Patent
Burroughs et al.

(10) Patent No.: US 6,757,997 B1
(45) Date of Patent: Jul. 6, 2004

(54) CENTERLINE-BASED ADJUSTABLE STITCHERY FRAME

(76) Inventors: Margaret E. Burroughs, P.O. Box 2235, Helendale, CA (US) 92342-2235; William H. Burroughs, P.O. Box 2235, Helendale, CA (US) 92342-2235; Henry Evan Burroughs, 6325 Joseph St. SE., Salem, OR (US) 97302

( * ) Notice: Subject to any disclaimer, the term of this patent is extended or adjusted under 35 U.S.C. 154(b) by 0 days.

(21) Appl. No.: 10/637,945

(22) Filed: Aug. 7, 2003

(51) Int. Cl.[7] ..... D06C 3/08
(52) U.S. Cl. ..... 38/102.6
(58) Field of Search ..... 38/102.1, 102.6, 38/102.3, 102.4, 102.5, 102.8, 102.91; 160/372, 374.1, 378, 381; 40/700; 101/127.1; 52/394

(56) References Cited

U.S. PATENT DOCUMENTS

| | | | | | |
|---|---|---|---|---|---|
| 326,744 | A | * | 9/1885 | Johnson | 38/102.6 |
| 2,451,207 | A | * | 10/1948 | Ferguson | 28/152 |
| 2,467,522 | A | * | 4/1949 | Cooper | 38/102.5 |
| 4,144,660 | A | * | 3/1979 | Lamb | 38/102.5 |
| 4,637,147 | A | * | 1/1987 | Wolsey | 38/102.1 |
| 5,144,899 | A | * | 9/1992 | Allen | 112/103 |
| 6,116,174 | A | * | 9/2000 | Melton | 112/103 |
| 6,240,863 | B1 | * | 6/2001 | Vickroy et al. | 112/475.18 |
| 6,604,306 | B1 | * | 8/2003 | Burroughs et al. | 38/102.4 |

* cited by examiner

*Primary Examiner*—Ismael Izaguirre
(74) *Attorney, Agent, or Firm*—Gene W. Arant

(57) ABSTRACT

A stitchery frame which is progressively expanded while in use to keep the fabric taut. Centerline markers are provided on side and end pieces of the frame to aid the process.

4 Claims, 2 Drawing Sheets

CENTERLINE-BASED ADJUSTABLE STITCHERY FRAME

PRIORITY CLAIM

This application discloses and claims an Improvement over the invention disclosed and claimed in our application Ser. No. 10/053,998, filed Jan. 24, 2002, to be issued as U.S. Pat. No. 6,604,306 on Aug. 12, 2003.

SUMMARY OF THE INVENTION

According to the invention an expandable stitchery frame has visible markings placed at the longitudinal center of each of its side and end pieces. Tension is applied from the frame to the fabric directly in the plane of the fabric by expanding the spacings between side pieces and end pieces. While doing so, the expansion movement is controlled so that a center point in the fabric remains substantially aligned with all four visible markers.

According to the presently preferred embodiment of the invention the end portions of all of the side and end pieces are of substantially identical configuration. When one of the frame members is inverted relative to another and they are arranged to form a right angle, their adjoining ends have tongue and groove structures which are interengaged, and each frame member may be moved away from the other associated frame member along the longitudinal axis of the other without interrupting the interengagement.

DRAWING SUMMARY

DETAILED DESCRIPTION

FIGS. 1–3

Figure 1:
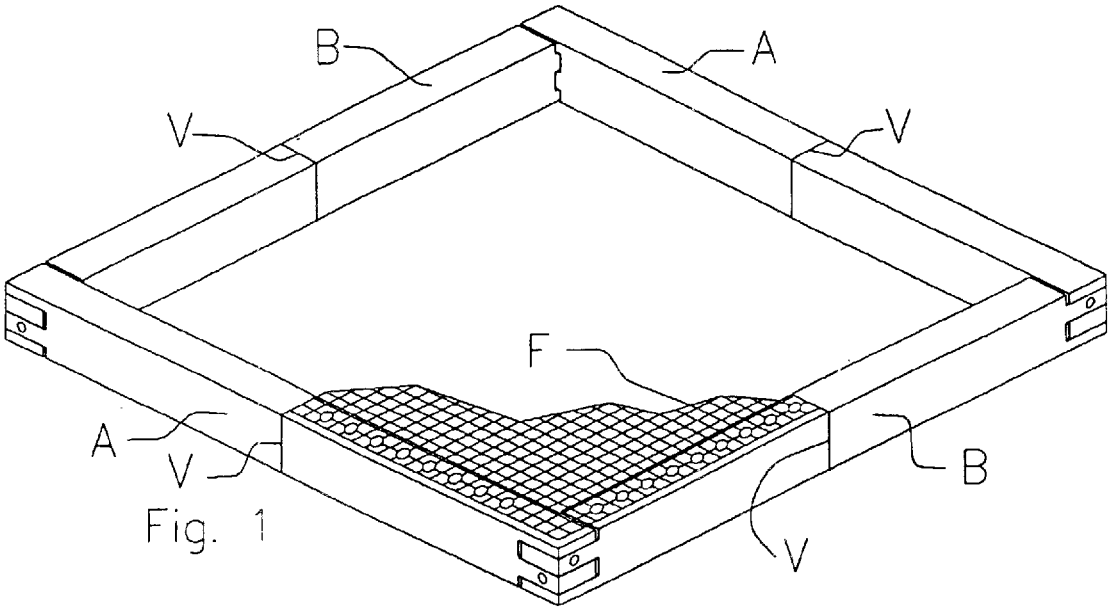
FIG. 1 is a perspective view of an expandable flame in accordance with the invention.

In the assembled frame of FIG. 1, the two side pieces are identified as A while the two end pieces are identified as B. Visible center markings on the side pieces and end pieces are identified as V. Fabric supported within the frame is identified as F.

Each end of each side piece and each end of each end piece has at one side thereof a transversely extending recess 10. A first tongue portion 12 borders the recess 10 and is parallel to it. A transverse groove 14 borders the other side of tongue 12 and is parallel to recess 10. A second tongue 16 is on the other side of groove 14.

The width of groove 14 is at least equal to the thickness of first tongue 12, so that the first tongue 12 of one of the side or end pieces may be slideably inserted into groove 14 of another.

Figure 2:
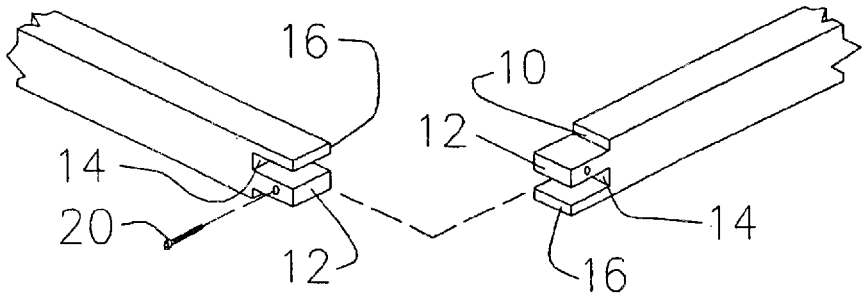
FIG. 2 is a fragmentary perspective view showing how when one member is inverted, end portions of two of the members may be slidingly interengaged.

When one frame member is inverted relative to another and their ends arranged to form a right angle, the second tongue 16 of one may occupy the recess 10 of the other, and the first tongue 12 of the one may occupy groove 14 of the other. See FIG. 2.

Figure 3:
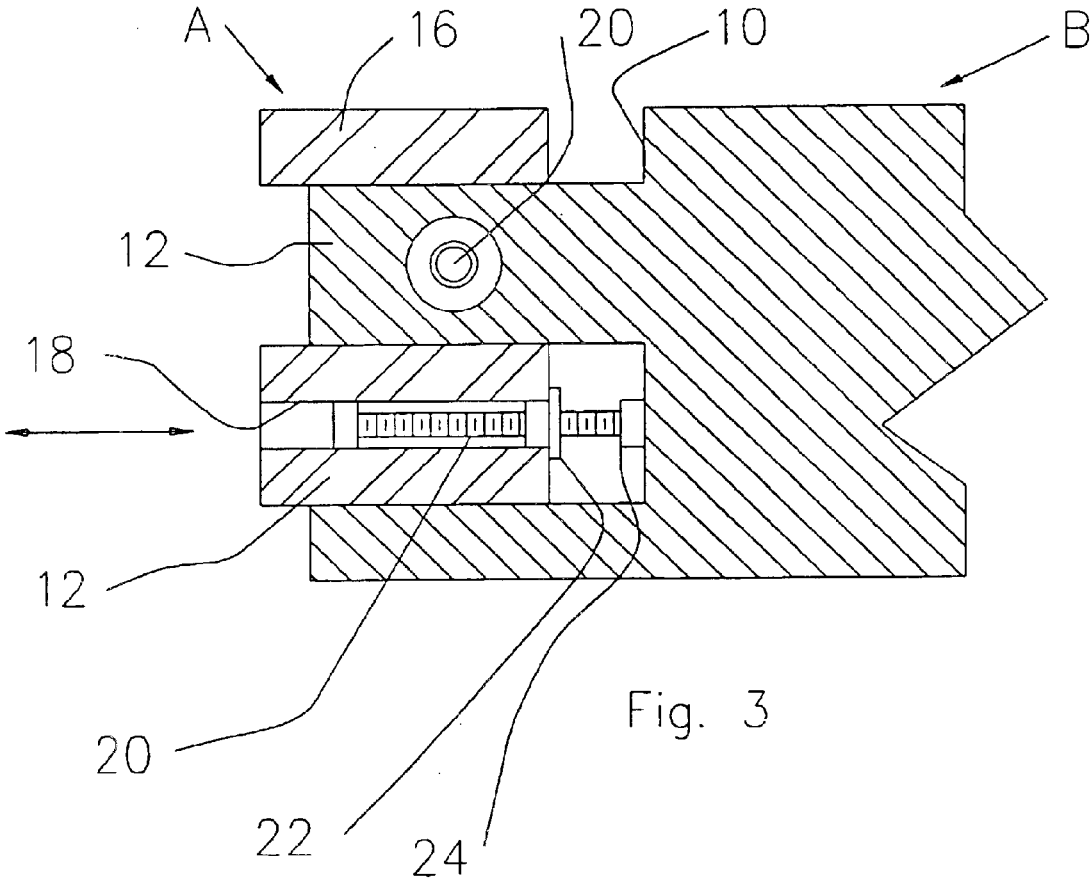
FIG. 3 is a fragmentary cross sectional view of the end portions of two interengaged frame members showing expansion screws adapted to selectively drive them apart.

The end portion of each side piece and each end piece has a hole or opening 18 through its first tongue portion 12. An expansion screw 20 with an allen wrench opening is inserted into and through opening 18 from the outer side of the frame member. A nut 22 embedded in the tongue portion on its inner surface (see FIG. 3) allows the screw to be rotatably driven for expanding the frame. A pressure plate 24 in the bottom of groove 14 receives axial pressure from the expansion screw 20.

While the frame may be square with side pieces and end pieces being of equal length, it may be preferred to have a rectangular frame in which the side pieces are longer than the end pieces. While the screw opening 20 is presently shown in tongue portion 12, it may if desired be in tongue 16 instead.

Method of Operation

According to the present invention the method of stitching a piece of fabric such as congress cloth, linen, or needlepoint canvas that is supported within a rectangular frame having side and end pieces is accomplished as follows. A visible marker is placed at the longitudinal center of each side and end piece. The fabric is placed within the frame. The corresponding fabric edges are attached. Tension is then applied from the frame to the fabric directly in the plane of the fabric by expanding the spacing between the side pieces and concurrently expanding the spacing between the end pieces. While expanding the spacings, the visible markers are observed and the movements of the end pieces and the side pieces are controlled so that a center point in the fabric remains substantially aligned with all four visible markers. Thereafter, stitches are added into the fabric while maintaining the tension thus applied to the fabric; and the spaces between the end pieces and side pieces of the frame are again expanded.

What we claim is:

1. The method of stitching a piece of fabric such as congress cloth, linen, or needlepoint canvas that is supported within a rectangular frame having side and end pieces, comprising the steps of:

placing a visible marker at the longitudinal center of each side and end piece;

placing the fabric within the frame;

attaching corresponding fabric edges along the side and end pieces;

applying tension from the frame to the fabric directly in the plane of the fabric by expanding the spacing between the side pieces and concurrently expanding the spacing between the end pieces;

while expanding the spacings between end pieces and between side pieces, observing the visible markers and controlling the movements of the end pieces and side pieces so that a center point in the fabric remains substantially aligned with all four visible markers;

adding stitches into the fabric while maintaining the tension thus applied to the fabric; and then again expanding the spaces between end pieces and side pieces of the frame.

2. A stitchery frame comprising four elongated frame members which are mutually interengageable at their ends to provide an adjustable frame having selectively expansive movement;

all eight of the frame ends being substantially identical, each having at one side thereof a transversely extending recess, a first tongue portion bordering the recess and parallel thereto, a transverse groove bordering the other side of the first tongue, and a second tongue on the other side of the groove; and the width of the groove being at least equal to the thickness of the first tongue;

whereby two of the frame members when inverted relative to each other and their ends arranged to form a right angle may then have the second tongue of one member occupying the recess of the other, the groove of the one member receiving the first tongue of the other, the second tongue of the one member occupying the groove of the other, and the recess of the one member then occupied by the second tongue of the other.

3. The frame of claim 2, wherein the depths of both the recess and the groove on each frame end significantly exceed the transverse width of the frame end, so that one frame end may be moved away from the associated frame member and yet remain interengaged therewith.

4. The frame of claim 2, wherein a tongue of each member has a hole extending theretrough, and wherein there is an embedded nut on the inner surface of the hole to allow an expansion screw when inserted into and through the hole to be rotatably driven for forceably moving the fame member in a direction along the longitudinal axis of the other interengaged frame member.

* * * * *